US005306608A

United States Patent [19]

Kato

[11] Patent Number: 5,306,608

[45] Date of Patent: Apr. 26, 1994

[54] DIRECT POSITIVE PHOTOGRAPHIC LIGHT-SENSITIVE MATERIAL

[75] Inventor: Kiyokatsu Kato, Kanagawa, Japan

[73] Assignee: Fuji Photo Film Co., Ltd., Kanagawa, Japan

[21] Appl. No.: 962,872

[22] Filed: Oct. 19, 1992

[30] Foreign Application Priority Data

Oct. 18, 1991 [JP] Japan ..... 3-297853

[51] Int. Cl.[5] ..... G03C 1/485

[52] U.S. Cl. ..... 430/547; 430/505; 430/577; 430/576; 430/567; 430/569; 430/603; 430/605; 430/940

[58] Field of Search ..... 430/572, 596, 598, 940, 430/567, 569, 577, 576, 547, 603, 605, 505

[56] References Cited

U.S. PATENT DOCUMENTS

| | | | |
|---|---|---|---|
| Re. 32,097 | 3/1986 | Silverman et al. | 430/598 |
| 3,206,313 | 9/1965 | Porter et al. | 430/569 |
| 5,030,553 | 6/1991 | Kuwashima et al. | 430/598 |

*Primary Examiner*—Thorl Chea

*Attorney, Agent, or Firm*—Sughrue, Mion, Zinn, Macpeak & Seas

[57] ABSTRACT

A direct positive photographic light-sensitive material comprises a support and a light-sensitive emulsion layer provided thereon which contains non-pre-fogged internal latent image type silver halide grains of a core/shell structure. The cores of the silver halide grains are treated with a spectral sensitizing dye and a chemical sensitizer.

5 Claims, No Drawings

DIRECT POSITIVE PHOTOGRAPHIC LIGHT-SENSITIVE MATERIAL

FIELD OF THE INVENTION

The present invention relates to a direct positive photographic light-sensitive material using an internal latent image type silver halide emulsion, which is capable of providing a direct positive image. More particularly, the invention relates to a direct positive photographic light-sensitive material which is advantageously used for preparing a color reversal paper, a color hard copy or a color proof.

BACKGROUND OF THE INVENTION

There has been well known a photographic process to obtain a direct positive image without conducting a reversal process or without using a negative film.

As a process of forming a positive image using a conventionally known direct positive silver halide photographic light-sensitive material, there is known a process of using a non-pre-fogged internal latent image type silver halide photographic emulsion. This process comprises imagewise exposing the light-sensitive material, then subjecting the material to fogging treatment, and simultaneously or thereafter subjecting the material to surface development.

The term "non-pre-fogged internal latent image type silver halide photographic emulsion" means a silver halide photographic emulsion in which the grains have a core/shell structure and have sensitivity specks substantially inside of the silver halide grains so that a latent image is formed mainly inside of the grains when the grains are exposed to light.

Various processes for obtaining a direct positive image are described in U.S. Pat. Nos. 2,592,250, 2,466,957, 2,497,875, 2,588,982, 3,317,322, 3,761,266, 3,761,276 and 3,796,577; and U.K. Patents No. 1,151,363, No. 1,150,553 and No. 1,011,062.

The mechanism of the direct positive image formation is considered as follow. Upon the imagewise exposure, so-called "internal latent image" is formed inside of silver halide grains. Then, by the subsequent fogging treatment, a surface desensitizing action caused by the internal latent image takes place. Through the surface desensitizing action, development specks (fog specks) are selectively formed only on the surface of unexposed silver halide grains, without forming development specks on the surface of exposed silver halide grains. Then, a photographic image (positive image) is formed within the unexposed area by the normal surface development process. The process of the above-mentioned fogging treatment can be performed by the so-called "light fogging method", in which whole surface of the light-sensitive layer is exposed to light, or the so-called "chemical fogging method", in which a nucleating agent is used.

A direct positive silver halide photographic light-sensitive material using such non-pre-fogged internal latent image type silver halide emulsion as mentioned above has been recently used for preparing a color reversal paper, a color hard copy or a color proof, because the material can be easily processed.

In the case of practically using the direct positive photographic light-sensitive material for the above-stated purpose, it is desired that an image provided by the light-sensitive material has a high maximum density and a low minimum density and also has excellent whiteness. The term "whiteness" means a color reproducibility when a white object is photographed. Since the above-mentioned light-sensitive material is restricted in the exposure region, the minimum density of an image provided thereby is an important factor. In addition, it is very important to make gradation of a toe part (in a characteristic curve) of the image much harder for the purpose of obtaining an excellent reproducibility, because the gradation of the toe part has an influence on the whiteness. (The whiteness is more increased as the gradation of a toe part of an image is made harder.)

There is known a method of incorporating a metal such as Mn, Pb, Zn or Cd into the non-pre-fogged internal latent image type silver halide grains to obtain an image having a high maximum density, a low minimum density and a hard gradation of the toe part, as described in Japanese Patent Provisional Publication No. 1(1989)-145647.

On the other hand, the light-sensitive material is desired to have a high sensitivity. To make the sensitivity of the light-sensitive material higher, an emulsion used therefor is generally subjected to chemical sensitization and spectral sensitization in the preparation stage of the emulsion. The spectral sensitization is carried out by adding a spectral sensitizing dye to the photographic emulsion as described in the above publication. In general, after the preparation of the emulsion (after the chemical sensitization of the emulsion) or during the preparation of a coating solution containing the emulsion (a coating solution for forming a light-sensitive layer), a spectral sensitizing dye is used. That is, the spectral sensitizing dye is introjuced prior to the coating process.

In the case of storing a direct positive photographic light-sensitive material for a long period of time (especially in the case of storing at a high temperature such as a temperature of 50° C. and 55% RH for 10 days), the following problems are observed after the storage: the light-sensitive material varies in the sensitivity, and an image provided by the material has a soft gradation in the toe part and has a high minimum density to reduce the whiteness. To solve these problems, the aforementioned method of incorporating a metal into the silver halide grains is effective, but further improvements are desired.

SUMMARY OF THE INVENTION

The object of the present invention is to provide a direct positive photographic light-sensitive material which shows stable sensitivity even after stored for a long period of time and which can provide an image of high whiteness.

The present inventor has found that a light-sensitive material having stable properties even after a storage of a long period of time can be obtained by using silver halide grains whose cores have been treated with a spectral sensitizing dye and a chemical sensitizer.

There is provided by the present invention a direct positive photographic material comprising a support and a light-sensitive emulsion layer provided thereon, said light-sensitive emulsion layer containing non-pre-fogged internal latent image type silver halide grains of a core/shell structure, wherein the cores of the silver halide grains are treated with a spectral sensitizing dye and a chemical sensitizer.

The direct positive photographic light-sensitive material of the present invention hardly varies in the sensitivity even after stored for a long period of time. Further, a direct positive image showing high whiteness can be obtained by the use of the direct positive photographic light-sensitive material of the invention.

DETAILED DESCRIPTION OF THE INVENTION

The direct positive photographic light-sensitive material of the present invention is described in detail hereinafter.

The grains contained in the non-pre-fogged internal latent image type silver halide emulsion which is used for the direct positive photographic light-sensitive material of the invention have a core/shell structure. Such grains can be prepared through a step of forming cores by mixing and reacting a soluble silver salt and a soluble halide in an aqueous gelatin solution and a step of forming shells around the cores by further growing the cores under the same precipitation conditions. Generally, the grains having the core/shell structure are subjected to chemical sensitization treatment in any of each steps after the formation of cores and shells. Further, after the preparation of the silver halide grains (i.e., after the formation of shells around the cores), the grains are subjected to flocculation or the like in accordance with a conventional process for preparing an emulsion.

The silver halide grains employable in the invention are characterized in that cores of the grains are treated with a spectral sensitizing dye and a chemical sensitizer. The treatment of the cores (core grains) with the spectral sensitizing dye and the chemical sensitizer is carried out by adding the spectral sensitizing dye and the chemical sensitizer to the emulsion containing cores (the core emulsion) after the formation of the cores is completed and keeping the emulsion at the pre-determined temperature. In this case, there is no specific limitation on the order of adding the spectral sensitizing dye and the chemical sensitizer to the core emulsion. However, it is preferred in the invention to add the spectral sensitizing dye to the core-containing emulsion (i.e., emulsion before the chemical sensitization) after the formation of cores, and then to add the chemical sensitizer to the emulsion.

The preferred treatment with the spectral sensitizing dye and the chemical sensitizer is described below in more detail.

The non-pre-fogged internal latent image type silver halide emulsion, the components (composition) of grains contained in the emulsion, the shape of the grains, etc. will be described later.

The spectral sensitizing dye to be added to the emulsion after the formation of cores is appropriately selected so that the emulsion has the desired light-sensitive region. There is no specific limitation on the spectral sensitizing dye employable in the invention, but useful are those belonging to cyanine dyes, merocyanine dyes and composite merocyanine dyes. These dyes can be used singly or in appropriate combinations. Examples of the dyes are described in "Research Disclosure", No. 17643-IV (December, 1978), pp. 23-24. The dyes can be employed in combination with a conventionally known supersensitizer.

The addition of the spectral sensitizing dye can be carried out in accordance with a known method. That is, the dye is dissolved in an appropriate organic solvent (e.g., methanol, ethanol and ethyl acetate) to give a solution of adequate concentration, and the solution is mixed with the emulsion. Otherwise, the dye may be added in the form of an aqueous dispersion obtained by dispersing the dye in an aqueous solution utilizing a surface active agent and the like or by dispersing the dye in an aqueous gelatin solution of adequate concentration. The spectral sensitizing dye may be added in its whole amount at the same time, or may be added in divided portions. Further, the dye may be added continuously over a certain period of time.

A pAg value of the emulsion at which the spectral sensitizing dye is added preferably is in the range of 6 to 12, more preferably 7 to 11, and a pH value thereof preferably is in the range of 3 to 12, more preferably 4 to 10. A temperature of the emulsion is preferably in the range of 40° to 90° C., more preferably 45° to 80° C.

The spectral sensitizing dye is used in such an amount that the grain formation is not inhibited in the subsequent shell forming stage. Further, the amount of the dye is determined depending on the kind of the dye. In the present invention, the amount of the spectral sensitizing dye preferably is in the range of $1.0\times10^{-6}$ mol to $1.0\times10^{-3}$ mol, more preferably $2.0\times10^{-6}$ mol to $5.0\times10^{-4}$ mol, per 1 mol of the silver halide.

After the addition of the spectral sensitizing dye, the emulsion is allowed to stand for at least 1 minute (preferably 1 to 20 minutes). Subsequently, to the emulsion is added a chemical sensitizer to subject the emulsion to chemical sensitization. Examples of the chemical sensitizers used for the chemical sensitization include a sulfur sensitizer, a precious metal sensitizer, a reduction sensitizer, a selenium sensitizer and a tellurium sensitizer. These chemical sensitizers can be used singly or in combination. In the invention, preferably carried out is sensitization using combination of a sulfur sensitizer and a precious metal sensitizer (particularly a gold sensitizer) or sensitization using combination of a sulfur sensitizer, a precious metal sensitizer (particularly a gold sensitizer) and a selenium sensitizer. Concrete examples of the above-mentioned sensitizers are briefly described below.

Examples of the sulfur sensitizers include unstable sulfur compounds which are conventionally known, such as thiosulfates (e.g., hypo), thioureas (e.g., diphenyl thiourea, triethyl thiourea and allyl thiourea) and rhodanines.

Examples of the precious metal sensitizers preferably used are sensitizers of gold, platinum, palladium and iridium. Of these, a gold sensitizer is particularly preferred. Concrete examples of the gold sensitizers include chloroauric acid, potassium chloroaurate, potassium aurithiocyanate, gold sulfide and gold selenide.

Examples of the selenium sensitizers preferably used are unstable selenium sensitizers described in Japanese Patent Publication No. 44(1979)-15748. Concrete examples thereof include colloidal selenium, selenoureas (e.g., N,N-dimethylselenourea, selenourea and tetramethylselenourea), selenoamides (e.g., selenoacetamide, N,N-diemthylselenobenzamide), selenoketones (e.g., selenoacetone and selenobenzophenone), selenides (e.g., triphenylphosphine selenide and diethyl selenide), selenophosphates (e.g., tri-p-tolylselenophosphate), selenocarboxylic acids and esters thereof, and isoselenocyanates.

Examples of the reduction sensitizers include stannous chloride, aminoiminomethanesulfinic acid, hydrazine derivative, borane compound (e.g., dimethylaminoborane), silane compound and polyamine compound.

Examples of the tellurium sensitizers include colloidal tellurium, telluroureas (e.g., allyl tellurourea, N,N-dimethyltellurourea, tetramethyltellurourea, N-carboxyethyl-N',N'-dimethyltellurourea, N,N'-dimethylethylenetellurourea and N,N'-diphenylethyelentellurourea), isotellurocyanates (e.g., allyl isotellurocyanate), telluroketones (e.g., telluroacetone and telluroacetophenone), telluroamides (e.g., telluroacetamide and N,N'-dimethyltellurobenzamide), tellurohydrazide (e.g., N', N'-trimethyltellurohydrazide), telluro esters (e.g., t-butyl-t-hexyltelluro ester), phosphine tellurides (e.g., tributylphosphine telluride, tricyclohexylphosphine telluride, triisopropylphosphine telluride, butyl-diisopropylphosphine telluride and dibutylphenylphosphine telluride), and other tellurium compounds (e.g., negative charge telluride ion-containing gelatin described in U.K. Patent No. 1,295,462, potassium telluride, potassium tellurocyanate, telluropentathionate sodium salt and allyl tellurocyanate).

In the above-mentioned chemical sensitization, a pAg value of the emulsion preferably is in the range of 6 to 11, more preferably 7 to 11. A pH value of the emulsion preferably is in the range of 3 to 11, more preferably 4 to 10. A temperature of the emulsion preferably is in the range of 40° to 90° C., more preferably 45° to 85° C. The above-defined temperature of the emulsion is kept for at least 1 minute, preferably 20 to 90 minutes, more preferably 25 to 75 minutes. The chemical sensitization may be carried out in the presence of the spectral sensitizing dye and the chemical sensitizer by adding the dye and the sensitizer together to the emulsion after the formation of cores.

The amount of the chemical sensitizer used in the invention, though varies depending on the kind and activity of the used sensitizer or the kind and size of the silver halide grains, is generally in the range of $1\times10^{-3}$ mol to $8\times10^{-3}$, preferably $2\times10^{-5}$ mol to $1\times10^{-3}$ mol, per 1 mol of the silver halide.

The cores of the silver halide grains having been subjected to chemical sensitization in the presence of the spectral sensitizing dye as described above grow under the same precipitation conditions as above to form shells. The silver halide grains thus obtained are then subjected to normal chemical sensitization. This normal chemical sensitization may be carried out in the presence of a spectral sensitizing dye in the similar manner to that of the above-described chemical sensitization. The spectral sensitizing dye used in this normal chemical sensitization may be the same as that used in the spectral sensitization of cores, or may be different in the absorption wavelength from that used in the spectral sensitization. As the chemical sensitizer used in this normal chemical sensitization, any chemical sensitizer can be used without specific limitation.

The photographic light-sensitive material of the invention which utilizes a non-pre-fogged internal latent image type silver halide emulsion containing the silver halide grains prepared as above may have such a structure that a single light-sensitive layer is provided on a support. However, preferred is such a structure that emulsion layers of three color sensitivities, that is, a red sensitive layer, a green sensitive layer and a blue sensitive layer, are provided on a support. In this embodiment, it it preferred that the red sensitive layer contains a non-pre-fogged internal latent image type silver halide emulsion and a cyan coupler, the green sensitive layer contains a non-pre-fogged internal latent image type silver halide emulsion and a magenta coupler, and the blue sensitive layer contains a non-pre-fogged internal latent image type silver halide emulsion and an yellow coupler.

The components constituting the light-sensitive material are illustrated below.

The non-pre-fogged internal latent image type silver halide emulsion used in the invention contains silver halide grains whose surfaces have not been pre-fogged and in which a latent image is formed mainly inside of the grains. A ratio of the maximum density of an image formed by using the following developing solution A (internal type developing solution) to that formed by using the following developing solution B (surface type developing solution) preferably is at least 5, more preferably at least 10. The maximum density of an image formed by using the solution A is determined by a normal photographic density measurement of an image obtained by the process comprising: coating a certain amount (0.5–3 g/m$^2$) of the emulsion on a transparent support; exposing to light the emulsion for a certain period within 0.01 to 10 seconds; and developing the emulsion in the developing solution A at 20° C. for 5 minutes. The maximum density of an image formed by using the solution B is determined in the same manner, except that development is carried out in the developing solution B at 18° C. for 6 minutes.

| | |
|---|---|
| Internal type developing solution A: | |
| Metol | 2.0 g |
| Anhydrous sodium sulfite | 90.0 g |
| Hydroquinone | 8.0 g |
| Sodium carbonate (monohydrate) | 52.8 g |
| KBr | 5.0 g |
| KI | 0.5 g |
| Water | to make up to 1,000 ml |
| Surface type developing solution B: | |
| Metol | 2.5 g |
| L-Ascorbic acid | 10.0 g |
| $NaBO_2.4H_2O$ | 35.0 g |
| KBr | 1.0 g |
| Water | to make up to 1,000 ml |

Concrete examples of the internal latent image type silver halide emulsions include conversion type silver halide emulsion described in U.S. Pat. No. 2,592,250; core/shell type silver halide emulsion described in U.S. Pat. Nos. 3,761,276, 3,850,637, 3,923,513, 4,035,185, 4,395,478 and 4,504,570, Japanese Patent Provisional Publications No. 52(1977)-156614, No. 55(1980)-127549, No. 53(1978)-60222, No. 56(1981)-22681, No. 59(1984)-208540, No. 60(1985)-107641, No. 61(1986)-3137 and No. 62(1987)-215272, German Patent No. 2332802c2, and the patents indicated on p.236 of Research Disclosure No. 23510 (November, 1983); core/shell type silver chloride emulsion described in U.S. Pat. No. 4,789,627; core/shell type silver chlorobromide emulsion described in Japanese Patent Provisional Publications No. 63(1988)-10160 and No. 63(1988)-47766, and Japanese Patent Application No. 1(1989)-2467; core shell type silver halide emulsion in which metallic ion is doped as described in Japanese Patent Provisional Publication No. 63(1988)-191145; and other core shell type silver halide emulsion described in Japanese Patent Provisional Publication No. 1(1989)-52146.

The non-pre-fogged internal latent image type silver halide grains used in the invention have a core/shell structure as described before. A molar ratio between silver halide in the cores of the silver halide grains and that in the shells of the silver halide grains is generally within the range of 20:1 to 1:100, preferably within the range of 1:1 to 1:25.

In the non-pre-fogged internal latent image type silver halide grains, at least one metal selected from the group consisting of Mn, Cu, Zn, Cd, Pb, Bi and metals belonging to Group VIII of a periodic table may be contained.

The amount of Mn, Cu, Zn, Cd, Pb, Bi or a metal belonging to Group VIII of a periodic table contained in the non-pre-fogged internal latent image type silver halide grains is preferably in the range of $10^{-0}$ to $10^{-2}$ mol, preferably $10^{-7}$ to $10^{-3}$ mol, per 1 mol of the silver halide.

Among the above metals, Pb (lead), Ir (iridium), Bi (bismuth) and Rh (rhodium) are preferably used.

The metal can be incorporated into the silver halide grains in the following manner. When a silver ion solution and an aqueous solution of halogen are mixed and stirred to form silver halide grains, the metal is added in the form of an aqueous solution of the metal (metallic ion) or in the form of a solution containing the metal (metallic ion) in an organic solvent to the above reaction mixture. Otherwise, the metal may be added to the above-mentioned aqueous halogen solution. Further, after the formation of the silver halide grains in the emulsion, the metal may be added to the emulsion in the form of the above-mentioned aqueous metal solution or organic metal solution, to incorporate the metal into the grains. In this case, the grains containing the metal may be further covered with silver halide. The metal is generally added in the form of a complex salt of the metal (complex) or in the form of a metal compound such as oxyacid salt of the metal or organic acid salt of the metal.

Methods for incorporating the metal into the silver halide grains are described in U.S. Pat. Nos. 3,761,276 and 4,395,478, and Japanese Patent Provisional Publication No. 59(1984)-216136.

The silver halide grains used in the invention may be of various crystal forms, for example, a regular crystal form such as hexahedron (cube), octahedron, dodecahedron or tetradecahedron (see: Japanese Patent Provisional Publication No. 2(1990)-223948) and an irregular crystal form such as spherical form or tabular form. Further, the shape of the grain may be complex of these crystals. A mixture of grains of various crystals is also employable. A tabular grain having a ratio of length/-thickness of not less than 5, particularly not less than 8, is described in Japanese Patent Provisional Publications No. 1(1989)-131547 and No. 1(1989)-158429. A silver halide emulsion containing such tabular grains in an amount of not less than 50% of the all projected area may be employed in the invention.

Examples of the silver halide include silver chloride, silver bromide and mixtures of silver halides. The silver halide preferably used in the invention is silver halide containing no silver iodide or silver halide containing silver iodide in an amount of not more than 3 mol %, for example, silver (iodo)chlorobromide, silver (iodo)chloride or silver (iodo)bromide.

A mean grain size of the silver halide grains preferably is in the range of 0.1 to 1.5 μm, more preferably 0.2 to 1.2 μm. The mean grain size is expressed by a mean grain diameter when the grains are spherical or nearly spherical, and expressed by a mean longitudinal length when the grains are in the form of cube, each based on the projected area. The grain size distribution of the silver halide grains may be either narrow or wide, but the grain size distribution preferably is narrow to improve graininess and sharpness of an image. For example, there is preferably used in the invention a silver halide emulsion in which the sizes of not less than 90% (in number of grains or weight of grains), particularly not less than 95%, of all grains are within a range of ±40%, preferably ±30%, more preferably ±20%, of the mean grain size. That is, so-called "monodispersed silver halide emulsion" is preferably used in the invention.

To obtain the desired gradation of an image provided by the light-sensitive material, two or more kinds of monodispersed silver halide emulsions which are substantially the same in the color sensitivity but different in the grain size may be used. Otherwise, plural kinds of the silver halide grains which are the same in the grain size but different in the sensitivity may be used in the same layer or separate layers. Further, two or more kinds of polydispersed silver halide emulsions or a combination of a monodispersed emulsion and a polydispersed emulsion can be also used.

The photographic emulsion used in the invention may contain antifogging agents to prevent fogging during the preparation process of the light-sensitive material, storage thereof and photographic process thereof, or may contain stabilizers to stabilize the photographic properties of the light-sensitive material. Concrete examples of the antifogging agents and the stabilizers are described, for example, in Research Disclosure No. 17643.VI (December, 1978) and E. J. Birr "Stabilization of Photographic Silver Halide Emulsion", (Focal Press, 1974).

Various color couplers can be used for the invention. Typical examples of useful color couplers include naphthol type compounds, phenol type compounds, pyrazolone type compounds, pyrazoloazole type compounds, non-cyclic ketomethylene compounds and heterocyclic ketomethylene compounds. Concrete examples of cyan, magenta and yellow couplers employable in the invention are described in Research Disclosure No. 17643 (December, 1978), P. 25, VII-D; ibid., No. 18717 (November, 1979), Japanese Patent Provisional Publication No. 62(1987)-215272, and the patents cited in these documents.

Examples of 5-pyrazolone type magenta couplers preferably used in the invention are 5-pyrazolone type couplers in which 3-position is substituted with an arylamino group or an acylamino group. A divalent coupler of sulfur eliminating type is preferred.

More preferably used in the invention are pyrazoloazole type couplers. Pyrazolo[5,1-c][1,2,4]triazoles described in U.S. Pat. No. 3,725,067 are preferred. From the viewpoints of small incidental absorption in yellow wavelength region and fastness to light, imidazo[1,2-b]pyrazoles described in U.S. Pat. No. 4,500,630 are more preferred, and pyrazolo[1,5-b][1,2,4]triazole described in U.S. Pat. No. 4,540,654 is most preferred.

Examples of the cyan couplers preferably used in the invention include naphthol type and phenol type couplers described in U.S. Pat. Nos. 2,474,293 and 4,052,212; and phenol type cyan couplers having an alkyl group (which is not smaller than ethyl group) at meta-position of phenol nucleus described in U.S. Pat. No. 3,772,002. Further, 2,5-diacylamino substituted phenol type couplers are also preferred from the view point of color fastness.

As the yellow couplers, those described in U.S. Pat. Nos. 3,933,501, 4022,620, 4,326,024 and 4,401,752, Japanese Patent Publication No. 58(1983)-10739, and U.K. Patents No. 1,425,020 and No. 1,476,760 are preferred.

Also employable are a colored coupler to compensate an incidental absorption of a formed dye in the short wave-length region, a coupler which gives a color developing dye exhibiting proper diffusion, a non-colored coupler, a DIR coupler which releases a development inhibitor by a coupling reaction, and a polymerized coupler.

A coupler which releases a photographically useful residue by coupling reaction can be also preferably used in the invention. As the DIR couplers which release a development inhibitor, preferred are those described in the patents cited in Research Disclosure No. 17643, VII-F, Japanese Patent Provisional Publications No. 57(1982)-151944, No. 57(1982)-154234 and No. 60(1985)-184248, U.S. Pat. No. 4,248,962, and Japanese Patent Provisional Publication No. 63(1988)-146035.

Preferred couplers which imagewise release a nucleating agent or a development accelerator in the development process are those described in U.K. Patents No. 2,907,140 and No. 2,131,188, Japanese Patent Provisional Publications No. 59(1984)-157638 and No. 59(1984)-170840, and International Application (WO) No. 88/1402.

The color coupler is generally used in an amount of 0.001 to 1 mol per 1 mol of the light-sensitive silver halide. Preferably, the yellow coupler is used in an amount of 0.01 to 0.5 mol, the magenta coupler is used in an amount of 0.03 to 0.5 mol, and the cyan coupler is used in an amount of 0.02 to 1.0 mol.

As a binder or a protective colloid employable for an emulsion layer or an intermediate layer of the light-sensitive material of the invention, gelatin is advantageously employed, but other hydrophilic colloids can be also employed.

A color fogging inhibitor or a color stain inhibitor can be also employed for the light-sensitive material of the invention. Typical examples thereof are described in Japanese Patent Provisional Publication No. 62(1987)-215272, pp. 185–193.

Examples of the compounds which release a photographically useful group are described in Japanese Patent Provisional Publications No. 63(1988)-153450, No. 63(1988)-259555, No. 2(1990)-61636, No. 2(1990)-244041 and No. (1990)-308240.

In order to improve color developing of the coupler, a color enhancing agent can be used for the invention. Typical examples thereof are described in Japanese Patent Provisional Publication No. 62(1987)-215272, pp. 121–125.

The light-sensitive material of the invention may contain various additives such as a dye for preventing irradiation or halation, an UV absorbent, a plasticizer, a brightening agent, a matting agent, an air-fogging preventing agent, a coating assisting agent, a hardening agent, an antistatic agent and an agent for improving slipperiness. As the dye for preventing irradiation or halation, compounds described in for example Japanese Patent Provisional Publications No. 2(1990)-85850 and No. 2(1990)-89047 may be employed. The dye may be added to the light-sensitive material by a solid fine crystal dispersing method.

Typical examples of those additives are described in Research Disclosure No. 17643, VII-XII, pp. 25–27, (December, 1978) and ibid., No. 18716, pp. 647–651 (November, 1979).

The light-sensitive material of the invention preferably has at least one red sensitive emulsion layer, one green sensitive emulsion layer and one blue sensitive emulsion layer on a support. The order of these layers can be optionally determined. Preferred is an order of a support, a red sensitive layer, a green sensitive layer and a blue sensitive layer, or an order of a support, a green sensitive layer, a red red sensitive layer and a blue sensitive layer. Each of these emulsion layers may comprise two or more emulsion layers different in the sensitivity. A non-light-sensitive layer may exist between two or more emulsion layers having the same color sensitivities. Generally, the red sensitive emulsion layer contains a cyan forming coupler, the green sensitive emulsion layer contains a magenta forming coupler, and the blue sensitive emulsion layer contains an yellow forming coupler. However, each of the emulsion layers may contain a combination of different couplers in some cases, for example, the green sensitive layer may contain an yellow coupler and a magenta coupler.

It is preferred that the light-sensitive material of the invention is optionally provided with auxiliary layers which are non-light-sensitive layers, such as a protective layer, an intermediate layer, a filter layer, an antihalation layer, a backing layer and a white reflection layer.

The fogging treatment of the photographic light-sensitive material of the invention is carried out by "light fogging method" and/or "chemical fogging method" described below. The exposure of the whole surface of the light-sensitive material in the light fogging method, namely fogging exposure, is conducted during or before the color development process after the imagewise exposure. In detail, the light-sensitive material having been imagewise exposed to light is exposed while immersing it in the color developing solution or a solution of the prebath thereof. Otherwise, the light-sensitive material taken out of any of those solutions is exposed before the material is not dried. It is most preferred that the material is exposed in the color developing solution.

A light source for the fogging exposure preferably is high in the color rendering properties (as white as possible). Examples of the light sources having high color rendering properties are described in Japanese Patent Provisional Publications No. 56(1981)-137350 and No. (1983)-70223. An illuminance of the light is generally in the range of 0.01 to 2,000 lux, preferably 0.05 to 30 lux, more preferably 0.05 to 5 lux. In the case where an emulsion of high sensitivity is used for the light-sensitive material, an exposure at a low illuminance is preferred. The illuminance can be adjusted by, for example, changing a luminous intensity of the light source, using various filters, or changing the distance or the angle between the light-sensitive material and the light source. The illuminance of the fogging light can be increased continuously or stepwise from a low level to a high level.

The exposure of the light-sensitive material in the light fogging method is preferably conducted after the material is immersed in the color developing solution or the solution of the prebath to allow the solution to well permeate the material. An interval between the permeation of the solution and the exposure for the light fogging generally is in the range of 2 seconds to 2 minutes, preferably 5 seconds to 1 minute, more preferably 10 seconds to 30 seconds.

The exposure time for the light fogging generally is in the range of 0.01 second to 2 minutes, preferably 0.1 second to 1 minute, more preferably 1 second to 40 seconds.

When the so-called "chemical fogging method" is carried out in the invention, a nucleating agent is employed. The nucleating agent can be incorporated into the light-sensitive material or a processing solution for the light-sensitive material. Preferably, the nucleating agent is incorporated into the light-sensitive material.

The nucleating agent used herein is a substance which serves to form a direct positive image during the surface development treatment of the non-pre-fogged internal latent image type silver halide emulsion. In the present invention, the fogging treatment is carried out preferably using the nucleating agent.

In the case where the nucleating agent is incorporated into the light-sensitive material, the nucleating agent is preferably added to the internal latent image type silver halide emulsion layer. However, the nucleating agent may be added to other layers such as an intermediate layer, a subbing layer and a backing layer, as far as the nucleating agent diffuses to adsorb onto the silver halide grains during the coating process or other processes.

Examples of the nucleating agents employable in the invention include quaternary heterocyclic compounds and hydrazine compounds described for example in Research Disclosure No. 22534, pp. 50–54, (January, 1983), ibid., No. 15162, pp. 76–77 (November, 1976) and ibid., No. 23510, pp. 346–352 (November, 1983). These nucleating agents may be used in combination of two or more compounds.

Examples of the nucleating agent preferably used in the invention are quaternary heterocyclic compounds represented by the formula (N-I) described in Japanese Patent Provisional Publication No. 3(1991)-155543, pp. 510–514, and hydrazine compounds represented by the formula (N-II) described in Japanese Patent Provisional Publication No. 3(1991)-95546, pp. 60–65.

Typical nucleating agents represented by the formulas (N-I) and (N-II) are given below.

(N-I-1)

7-(3-cyclohexylmethoxythiocarbonylaminobenzamido)-10-propargyl-1,2,3,4-tetrahydroacridinium trifluoromethanesulfonate (N-I-2)

6-(3-methoxythiocarbonylaminobenzamido)-1-propargyl-2,3-trimethylenequinolinium trifluoromethanesulfonate (N-I-3)

6-ethoxythiocarbonylamino-2-methyl-1-propargylquinolinium trifluoromethanesulfonate (N-I-4)

7-[3-(5-mercaptotetrazole-1-yl)benzamido]-10-propargyl-1,2,3,4-tetrahydroacridinium perchlorate (N-II-1)

1-formyl-2-{4-[3-{3-[3-(5-mercaptotetrazole-1-yl)phenyl]ureido}benzsulfonamido]phenyl}hydrazine (N-II-2)

1-formyl-2-{4-[3-(5-mercaptotetrazole-1-yl)benzenesulfonamide]phenyl}hydrazine

A combination of the quaternary heterocyclic compound and the hydrazine compound is preferably used in the invention.

In the case where the nucleating agent is added to a processing solution, the nucleating agent is incorporated into the developing solution or the prebath having a low pH value as described in Japanese Patent Provisional Publication No. 58(1983)-178350.

The amount of the nucleating agent to be added to the processing solution is preferably in the range of $10^{-8}$ to $10^{-1}$ mol, more preferably $10^{-7}$ to $10^{-3}$ mol, per 1 liter of the processing solution.

The nucleating agent may be contained in the hydrophilic colloidal layer which is placed in contact with the silver halide emulsion layer, but preferably it is contained in the silver halide emulsion layer in the invention. The nucleating agent can be contained in the layer in an amount of wide range, depending on the nature of the used silver halide emulsion, chemical structure of the nucleating agent and developing conditions. However, the amount thereof generally is in the range of about $1\times10^{-8}$ mol to about $1\times10^{-3}$ mol, preferably about $1\times10^{-5}$ mol to about $1\times10^{-3}$ mol, based on 1 mol of silver contained in the silver halide emulsion.

In the case of using the nucleating agent, a nucleating promoter is preferably used together to promote the action of the nucleating agent.

The nucleating promoter is a substance which has substantially no function as a nucleating agent but has a function of promoting the action of the nucleating agent to enhance the maximum density of a direct positive image provided by the light-sensitive material and/or to shorten the developing time required for obtaining a certain maximum density of the direct positive image.

Examples of the nucleating promoters include thiadiazoles, oxadiazoles, benzotriazoles, tetrazindenes, triazaindenes, pentazaindenes (these have at least one mercapto group which may be optionally substituted with alkali metal atom or ammonium group), and compounds described in Japanese Patent Provisional Publication No. 63(1988)-106656, pp. 5–16. Also employable are compounds described in Japanese Patent Provisional Publications No. 63(1988)-226652, 63(1988)-106656 and 63(1988)-8740. These nucleating promoters may be used in combination of two or more kinds.

The nucleating promoter may be contained either in the light-sensitive material or in a processing solution. Preferably, the nucleating promoter is contained in the internal latent image type silver halide emulsion layer or other hydrophilic colloidal layers (e.g., an intermediate layer and a protective layer) of the light-sensitive material. More preferably, the nucleating promoter is contained in the silver halide emulsion layer or layers which are placed in contact with the emulsion layer.

The amount of the nucleating promoter to be contained in the light-sensitive material generally is in the range of of $10^{-6}$ to $10^{-2}$ mol, preferably in the range of $10^{-5}$ to $10^{-2}$ mol, per 1 mol of the silver halide.

In the case where the nucleating promoter is added to a processing solution (i.e., a developing solution or a solution of the prebath), the amount of the nucleating promoter preferably is in the range of $10^{-8}$ to $10^{-3}$ mol, more preferably in the range of $10^{-7}$ to $10^{-4}$ mol, per 1 liter of the processing solution.

A variety of known photographic additives employable in the invention are described in Research Disclosure No. 17643 (December, 1978) and ibid., No. 18716 (November, 1979). The relevant parts in the literatures are described below in the form of a table.

| Additives | R.D. No. 17643 | R.D. No. 18716 |
|---|---|---|
| 1. Chemical Sensitizer | p. 23 | p. 648, right column |
| 2. Sensitivity Promoter | | same as above |
| 3. Spectral Sensitizer and Supersensitizer | pp. 23–24 | pp. 648, right column–649, right column |
| 4. Brightening Agent | p. 24 | |
| 5. Antifogging Agent and Stabilizer | pp. 24–25 | pp. 649, right column–650, right column |
| 6. Light Absorbent, Filter Dye and UV Absorbent | p. 25, right column | pp. 649, right column–650, left column |
| 7. Stain Inhibitor | p. 25, right column | |
| 8. Dye Image Stabilizer | p. 25 | |
| 9. Hardening Agent | p. 26 | p. 651, left column |
| 10. Binder | p. 26 | same as above |

The light-sensitive emulsion layer and other layers of the light-sensitive material of the invention are provided on a flexible support such as plastic film, paper and cloth, or a rigid support such as glass, ceramics and metal (these supports are generally used for conventional light-sensitive materials).

Useful flexible supports include films of synthetic and semi-synthetic polymers such as cellulose nitrate, cellulose acetate, cellulose acetate butyrate, polystyrene, polyvinyl chloride, polyethylene terephthalate and polycarbonate; and papers coated or laminated with baryta layer or an α-olefin polymer (e.g., polyethylene, polypropylene or ethylene/butene copolymer). The support may be colored with dye or pigment.

Coating of the silver halide photographic emulsion layer and other hydrophilic colloidal layers on the support can be carried out in accordance with various known methods such as dip coating method, roller coating method, curtain coating method, extrusion coating method, and optionally, multi-layer simultaneous coating method described in U.S. Pat. Nos. 2,681,294, 2,761,791, 3,526,528 and 3,508,947.

Next, an image forming method using the above-described direct positive photographic light-sensitive material is briefly described.

The light-sensitive material is imagewise exposed and then subjected to a development process to obtain a positive image. As the development process, either a black and white development or a color development is carried out depending on the kind of the light-sensitive material.

A color developing solution used in the color development of the light-sensitive material of the invention preferably is an alkaline aqueous solution containing an aromatic primary amine color developing agent as a host component. Examples of the color developing agent preferably used are p-phenylenediamine derivatives. Typical examples thereof include 4-amino-N-ethyl-N-β-hydroxyethylaniline, 3-methyl-4-amino-N-ethyl-N-β-methanesulfonamidethylaniline, 3-methyl-4-amino-N-ethyl-N-β-hydroxyethylaniline and sulfates, chlorides or p-toluenesulfonates of these compounds. However, the color developing agents employable in the invention are in no way limited to those examples.

The aromatic primary amine developing agent is preferably used in an amount of not less than 50 mol % based on the amount of the developing solution.

After the color development process, the light-sensitive material is generally subjected to a desilvering treatment comprising a bleaching process and a fixing process, and then subjected to a washing process and/or a stabilizing process.

With respect to the above processes, processes described in Japanese Patent Provisional Publication No. (1991)-120537, pp. 380–381 can be preferably utilized.

The black and white development can be preferably carried out in accordance with a process described in the above publication (pp. 379–380).

The present invention is further described by the following examples, but the invention is in no way restricted to the examples.

EXAMPLE 1

Preparation of emulsion (EM-1)

To an aqueous solution of gelatin was added 0.3 g of 3,4-dimethyl-1,3-thiazoline-2-thion based on 1 mol of silver. To the gelatin solution were further added an aqueous solution of potassium bromide and silver nitrate at the same time with vigorous stirring over 15 minutes at 65° C. to obtain octahedral silver bromide grains having a mean grain size of 0.23 μm (Step 1). To the resulting emulsion, 6 mg of sodium thiosulfate and 7 mg of chloroaurate (tetrahydrate) based on 1 mol of silver were successively added, and the resulting mixture was heated at 75° C. for 80 minutes to perform chemical sensitization (Step 2). The obtained grains (core grains) were further grown under the same condition as the first precipitation to prepare a monodispersed octahedral core/shell silver bromide emulsion in which a mean grain size of the grains was 0.4 μm and a coefficient of variation of grain size was approximately 10%.

To the emulsion were added 1.5 mg of sodium thiosulfate and 1.5 mg of chloroaurate (tetrahydrate) based on 1 mole of silver, and the resulting mixture was heated at 60° C. for 60 minutes to perform chemical sensitization. Thus, an internal latent image type silver halide emulsion (EM-1) was obtained (Step 3).(core:-shell=1:4)

Preparation of emulsions (EM-2), (EM-3) and (EM-4)

The procedure for preparing the above emulsion (EM-1) was repeated except for adding 0.25 mmol of each of the following spectral sensitizing dye (S-1), (S-2) and (S-3) based on 1 mol of silver after the formation of core grains (Step 1) and before the chemical sensitization (Step 2), to prepare emulsions (EM-2), (EM-3) and (EM-4).

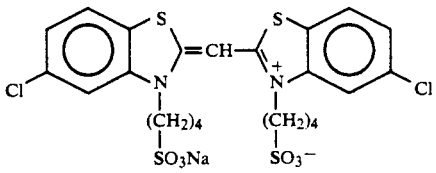

(S-1)

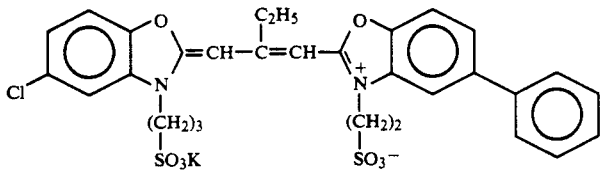

(S-2)

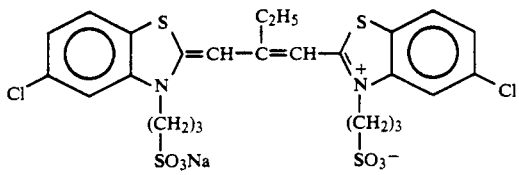

(S-3)

Preparation of emulsions (EM-5), (EM-6) and (EM-7)

The procedure for preparing the above emulsion (EM-1) was repeated except for adding each of the same spectral sensitizing dye (S-1), (S-2) and (S-3) as used in the above in the same amount after the chemical sensitization (Step 2) to prepare emulsions (EM-5), (EM-6) and (EM-7).

Preparation of emulsions (EM-8), (EM-9) and (EM-10)

The procedure for preparing the above emulsion (EM-1) was repeated except for adding each of the same spectral sensitizing dye (S-1), (S-2) and (S-3) as used in the above in the same amount immediately after the surface chemical sensitization (Step 3), to prepare emulsions (EM-8), (EM-9) and (EM-10).

Using the above-obtained emulsions, a light-sensitive material (sample) was prepared in the following manner.

Preparation of light-sensitive material

Preparation of sample 101

A paper was laminated with polyethylene on both sides to prepare a paper support (thickness: 220 μm). On one surface (front surface) of the paper support, the following first and second layers were provided to prepare a sample 101.

The composition and the amount (g/m$^2$) of each component of the first and second layers are described below. The value for the silver halide emulsion means the coating amount in terms of silver. The sensitizing dye (S-1) in the first layer (emulsion layer) was added to a coating solution for forming the first layer. The amount of the sensitizing dye (S-1) is based on 1 mol of silver (mmol/1 mol of silver).

| | |
|---|---|
| The first layer (emulsion layer) | |
| Emulsion (EM-1) | 0.20 |
| Sensitizing dye (S-1) | 0.25 |
| Gelatin | 2.00 |
| Cyan coupler (mixture of ExC-1, 2 in the ratio of 1:1) | 0.24 |
| Coupler solvent (di(2-ethylhexyl)sabacate) | 0.29 |
| The second layer (protective layer) | |
| Gelatin | 2.00 |
| Gelatin hardening agent (1,2-bis(vinylsulfonylacetamido)ethane) | 0.04 |

In the first layer, each of the following nucleating agents (ExZK-1) and (ExZK-2) was used in an amount of $10^{-3}$ wt. %, and the following nucleating promoter (Cpd-22) was used in an amount of $10^{-2}$ wt. %.

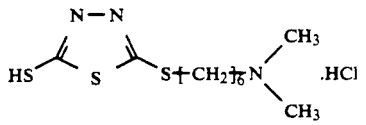

(Cpd-22)

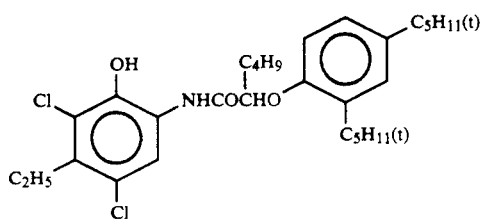

(EXC-1)

-continued (EXC-2)

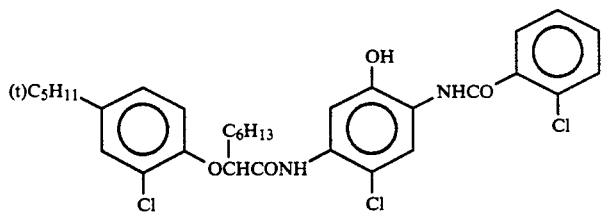

(ExZK-1)

7-(3-ethoxythiocarbonylaminobenzamido)-9-methyl-10-propargyl-1,2,3,4-tetrahydroacridinium trifluoromethanesulfonate (ExZK-2)

2-[4-{3-[3-{3-[5-{3-[2-chloro-5-(1-dodecyloxy--carbonylethoxycarbonyl)phenylcarbamoyl]-4-hydroxy-1-naphthylthio}tetrazole-1-yl]phenyl}ureido]benzenesulfonamido}phenyl]-1-formylhydrazine Preparation of samples 101-110

The procedure for preparing the above sample 101 was repeated except for using each of the emulsions (EM-2) to (EM-10) instead of the emulsion (EM-1) and not using the sensitizing dye (S-1), to prepare samples 102 to 110.

Evaluation of direct positive photographic light-sensitive material

The samples obtained as above were stored (incubated) for 10 days at a temperature of 50° C. and a relative humidity of 55%. Each of the samples having been not stored (i.e., samples before storage) and the samples having been stored as above (i.e., samples after storage) was subjected to wedge exposure (1/10 sec, 300 cms, color temperature: 4,800° K) through a gelatin filter (BPB-45, available from Fuji Photo Film Co., Ltd.) and then subjected to the following development process to obtain images. Each of the obtained images was measured on the cyan image density to obtain a characteristic curve.

Utilizing the characteristic curve, a variation of each sample in the sensitivity between before and after the storage (incubation) was determined from a difference of logarithm of the exposure light amount at an optical density of Dmin+0.6, and the sample was evaluated based on the difference of relative sensitivity (Δlog E).

The gradation of the toe part of each image was evaluated by a difference between the exposure light amount at an optical density of Dmin+0.1 and the exposure light amount at an optical density of Dmin+0.6 in the case of logarithmically plotting the exposure light amount as abscissa. When a value of the difference of the exposure light amount is small, the gradation of the toe part is hard and preferred. A variation in Dmin (minimum density) of each image was also examined. The whiteness of each image was evaluated by the gradation of the toe part and Dmin. When the gradation of the toe part is hard and Dmin is low, the whiteness of the image is excellent.

The results obtained by the above test are set forth in Table 1.

Color development process

Each of the samples having been subjected to the exposure process as above was then subjected to the following process by means of an automatic developing machine under the conditions described below. When the accumulated amount of replenisher reached three times of the volume of the tank, the process was terminated.

| Process | Period (sec) | Temperature (°C.) | Volume of the Tank | Replenisher |
|---|---|---|---|---|
| Color Development | 135 | 38 | 28 liters | 240 ml/m$^2$ |
| Bleach-fix | 40 | 35 | 11 liters | 320 ml/m$^2$ |
| Washing (1) | 40 | 35 | 7 liters | — |
| Washing (2) | 40 | 35 | 7 liters | 320 ml/m$^2$ |
| Drying | 30 | 80 | — | — |

The washing water was replenished in accordance with so-called counter current replenishing system in which the replenisher was introduced to the washing bath (2) and the over flowed liquid of the washing bath (2) was introduced to the washing bath (1). The amount of the liquid carried by the light-sensitive material from the bleach-fix bath into the washing bath (1) was 35 ml/m$^2$.

Followings are the composition of each processing solution.

| | Mother liquid | Replenisher |
|---|---|---|
| Color developing solution | | |
| D-Sorbitol | 0.15 g | 0.20 g |
| Sodium naphthalenedisulfonate.formalin condensation product | 0.15 g | 0.20 g |
| Nitrilotris(methylenephosphonate) pentasodium salt | 1.8 g | 1.8 g |
| Diethylenetriaminepentaacetic acid | 0.50 g | 0.50 g |
| 1-Hydroxyethylidene-1,1-diphosphonic acid | 0.15 g | 0.15 g |
| Diethylene glycol | 12.0 ml | 16.0 ml |
| Benzyl alcohol | 13.5 ml | 18.0 ml |
| Potassium bromide | 0.70 g | — |
| Benzotriazole | 0.003 g | 0.004 g |
| Sodium sulfite | 2.8 g | 3.7 g |
| Hydroxylamine.½sulfate | 3.0 g | 4.0 g |
| Triethanolamine | 6.0 g | 8.0 g |
| 4-[N-Ethyl-N-(β-hydroxyethyl)-amino]anilinesulfate.½hydrate | 4.2 g | 5.6 g |
| Potassium carbonate | 30.0 g | 25.0 g |
| Brightening agent (diaminostilbene type) | 1.3 g | 1.7 g |
| Water | to make up to 1000 ml | 1000 ml |
| pH (25° C.) (adjusted by KOH or sulfuric acid) | 10.35 | 10.93 |
| Bleach-Fix Solution | | |
| Disodium ethylenediamine tetraacetate dihydrate | 4.0 g | Same |
| Ammonium ethylenediamine tetraacetate Fe(III) dihydrate | 55.0 g | Same |
| Ammonium thiosulfate (750 g/l) | 168 ml | Same |
| Sodium p-toluenesulphinate | 30.0 g | Same |
| Ammonium sulfite | 35.0 g | Same |
| 5-Mercapto-1,3,4-triazole | 0.5 g | Same |
| Ammonium nitrate | 10.0 g | Same |
| Water | to make up to 1000 ml | Same |

-continued

| | Mother liquid | Replenisher |
|---|---|---|
| pH (25° C.) (adjusted by ammonia water or acetic acid | 6.20 | Same |
| Washing Water | | |
| Sodium chlorinated isocyanurate | 0.02 g | Same |
| Deionized water (conductivity: not more than 5 μs/cm) | 1,000 ml | Same |
| pH | 6.50 | Same |

TABLE 1

| Sample No. | Sensitizing dye Kind | Sensitizing dye Addition | Variation of Sensitivity (ΔlogE) | Gradation of Toe part Before storage | Gradation of Toe part After storage | Minimum Density Before storage | Minimum Density After storage |
|---|---|---|---|---|---|---|---|
| 101 (Comp.) | S-1 | (*1) | 0.10 | 0.19 | 0.25 | 0.100 | 0.120 |
| 102 (Ex.) | S-1 | (*2) | 0.03 | 0.19 | 0.20 | 0.100 | 0.105 |
| 103 (Ex.) | S-2 | (*2) | 0.02 | 0.20 | 0.21 | 0.102 | 0.106 |
| 104 (Ex.) | S-3 | (*2) | 0.01 | 0.20 | 0.20 | 0.095 | 0.100 |
| 105 (Ex.) | S-1 | (*3) | 0.08 | 0.19 | 0.22 | 0.100 | 0.119 |
| 106 (Ex.) | S-2 | (*3) | 0.09 | 0.20 | 0.23 | 0.101 | 0.120 |
| 107 (Ex.) | S-3 | (*3) | 0.07 | 0.19 | 0.21 | 0.095 | 0.112 |
| 108 (Comp.) | S-1 | (*4) | 0.11 | 0.19 | 0.24 | 0.103 | 0.125 |
| 109 (Comp.) | S-2 | (*4) | 0.12 | 0.20 | 0.25 | 0.101 | 0.121 |
| 110 (Comp.) | S-3 | (*4) | 0.10 | 0.19 | 0.22 | 0.096 | 0.110 |

(*1): The sensitizing dye was added to the coating solution for forming an emulsion layer.
(*2): The sensitizing dye was added after the formation of core grains of Step 1.
(*3): The sensitizing dye was added to the emulsion (core) having been subjected to the chemical sensitization of Step 2.
(*4): The sensitizing dye was added to the emulsion having been subjected to the surface chemical sensitization of Step 3.

As is evident from the results set forth in Table 1, the light-sensitive materials of the invention (samples 102 to 107) had small difference in the sensitivity between before and after the storage, and the images provided by the materials hardly varied in the gradation of the toe part and in the minimum density even after the materials were stored, resulting in high whiteness. In contrast thereto, the light-sensitive materials for comparison (samples 101, and 108 to 110) had a large difference in the sensitivity between before and after the storage, and the images provided by the materials largely varied both in the gradation of the toe part and the minimum density after the materials were stored, resulting in inferior whiteness.

EXAMPLE 2

Preparation of light-sensitive material

Preparation of sample 201

A paper was laminated with polyethylene on both sides to prepare a paper support (thickness: 100 mm). On one surface (front surface) of the paper support were provided the following first to eleventh layers, and on the other surface (back surface) were provided the following twelfth and thirteenth layers, to prepare a color photographic light-sensitive material (sample for comparison).

Polyethylene on the front surface side included titanium oxide (4 g/m$^2$) as a white pigment and a small amount (0.003 g/m$^2$) of ultramarine as a blue dye. (Chromaticities of the surface of the support were determined to be 88.0, −0.20, −0.75 in L*, a*, b* system, respectively.)

Composition of the layers

The composition and the amount (g/m$^2$) of each component of the layers are described below. The value for each sensitizing dye means an amount (by mol) based on 1 mol of silver. The value for each silver halide means an amount in terms of silver. The aforementioned emulsion (EM-1) was used as an emulsion for the red sensitive layer, and the emulsion (EM-1) was also used as an emulsion for the green sensitive layer. As an emulsion for the blue sensitive layer, a monodispersed octahedral core/shell silver bromide emulsion (mean grain size of grains: 0.6 μm) obtained in accordance with the process for preparing the emulsion (EM-1) except for changing the temperature for forming grains to 75° C. was used. The sensitizing dye was added to the emulsion immediately before the preparation of a coating solution for forming a light-sensitive layer. The emulsion of the eleventh layer was a Lippmann emulsion which had not been subjected to surface chemical sensitization.

| | |
|---|---|
| The first layer (Antihalation layer) | |
| Black colloidal silver | 0.10 |
| Color stain inhibitor (Cpd-7) | 0.05 |
| Color stain inhibitor solvent (mixture of Solv-4, 5 in the ratio of 1:1) | 0.12 |
| Gelatin | 0.70 |
| The second layer (Intermediate layer) | |
| Gelatin | 0.70 |

The third layer (Red sensitive layer)

Silver bromide spectrally sensitized with red sensitizing dye (mixture of ExS-1, 2 in the ratio of 1:1, total: $2.5\times10^{-4}$) [emulsion (EM-1), mean grain size: 0.4 μm; size distribution (coefficient of variation): 10 %; octahedral]0.28

| | |
|---|---|
| Gelatin | 1.00 |
| Cyan coupler (mixture of ExC-1, 2, 3 in the ratio of 1:1:0.2) | 0.30 |
| Discoloration inhibitor (mixture of Cpd-1, 2, 3, 4, 30 in the ratio of 1:1:1:1:1) | 0.18 |
| Stain inhibitor (mixture of Cpd-5, 15 in the ratio of 1:1) | 0.003 |
| Coupler dispersion medium (Cpd-6) | 0.03 |
| Coupler solvent (mixture of Solv-1, 2, 3 in the ratio of 1:1:1) | 0.12 |
| The fourth layer (Intermediate layer) | |
| Gelatin | 1.00 |
| Color stain inhibitor (Cpd-7) | 0.08 |
| Color stain inhibitor solvent (mixture of Solv-4, 5 in the ratio of 1:1) | 0.16 |
| Polymer latex (Cpd-8) | 0.10 |
| The fifth layer (Green sensitive layer) | |
| Silver bromide spectrally sensitized with green sensitizing dye (ExS-4, $2.6\times10^{-4}$) [mean grain size: 0.40 μm; size distribution: 10%; octahedral] | 0.25 |
| Gelatin | 0.80 |
| Magenta coupler (mixture of ExM-1, 2 in the ratio of 1:1) | 0.11 |
| Yellow coupler (ExY-1) | 0.03 |
| Discoloration inhibitor (mixture of Cpd-9, 26, 30 in the ratio of 1:1:1) | 0.15 |
| Stain inhibitor (mixture of Cpd-10, 11, 12, 13 in the ratio of 10:7:7:1) | 0.025 |
| Coupler dispersion medium (Cpd-6) | 0.05 |
| Coupler solvent (mixture of Solv-4, 6 in the ratio of | 0.15 |

-continued

| | |
|---|---|
| 1:1) | |
| The sixth layer (Intermediate layer) | |
| The same as the fourth layer | |
| The seventh layer (Yellow filter layer) | |
| Yellow colloidal silver (grain size: 100Å) | 0.12 |
| Gelatin | 0.70 |
| Color stain inhibitor (Cpd-7) | 0.03 |
| Color stain inhibitor solvent (mixture of Solv-4, 5 in the ratio of 1:1) | 0.10 |
| Polymer latex (Cpd-8) | 0.07 |
| The eighth layer (Intermediate layer) | |
| The same as the fourth layer | |
| The ninth layer (Blue sensitive layer) | |
| Silver bromide spectrally sensitized with blue sensitizing dye (mixture of ExS-4, 5 in the ratio of 1:1, total: $3.5 \times 10^{-4}$) [mean grain size: 0.60 μm; size distribution: 10%; octahedral] | 0.40 |
| Gelatin | 0.80 |
| Yellow coupler (mixture of ExY-2, 3 in the ratio of 1:1) | 0.35 |
| Discoloration inhibitor (Cpd-14) | 0.10 |
| Discoloration inhibitor (Cpd-30) | 0.05 |
| Stain inhibitor (mixture of Cpd-5, 15 in the ratio of 1:5) | 0.007 |
| Coupler dispersion medium (Cpd-6) | 0.05 |
| Coupler solvent (Solv-2) | 0.10 |
| The tenth layer (Ultraviolet absorbing layer) | |
| Gelatin | 1.00 |
| Ultraviolet absorbent (mixture of Cpd-2, 4, 16 in the ratio of 1:1:1) | 0.50 |
| Color stain inhibitor (mixture of Cpd-7, 17 in the ratio of 1:1) | 0.03 |
| Dispersion medium (Cpd-6) | 0.02 |
| Ultraviolet absorbent solvent (mixture of Solv-2, 7 in the ratio of 1:1) | 0.08 |
| Irradiation inhibiting dye (mixture of Cpd-18, 19, 20, 21, 27 in the ratio of 10:10:13:15:20) | 0.05 |
| The eleventh layer (Protective layer) | |
| Fine grains of silver iodobromide [silver iodide: 99 mol %; mean grain size: 0.05 μm] | 0.03 |

-continued

| | |
|---|---|
| Acrylic-modified poly(vinyl alcohol) copolymer [molecular weight: 50,000] | 0.01 |
| Mixture of grains of polymethyl methacrylate [mean grain size: 2.4 μm] and grains of silicon oxide [mean grain size: 5 μm] in the ratio of 1:1 | 0.05 |
| Gelatin | 1.80 |
| Gelatin hardening agent (mixture of H-1, 2 in the ratio of 1:1) | 0.18 |
| The twelfth layer (Reverse layer) | |
| Gelatin | 2.50 |
| Ultraviolet absorbent (mixture of Cpd-2, 4, 16 in the ratio of 1:1:1) | 0.50 |
| Dye (mixture of Cpd-18, 19, 20, 21, 27 in the ratio of 1:1:1:1:1) | 0.06 |
| The thirteenth layer (Reverse protective layer) | |
| Mixture of grains of polymethyl methacrylate [mean grain size: 2.4 μm] and grains of silicon oxide [mean grain size: 5 μm] in the ratio of 1:1 | 0.05 |
| Gelatin | 2.00 |
| Gelatin hardening agent (mixture of H-1 and H-2 in the ratio of 1:1) | 0.14 |

Nucleating agents of ExZK-1 and ExZK-2 (in amounts of $10^{-3}$ wt. % and $10^{-2}$ wt. % respectively based on the amount of silver halide) and nucleating promoters of Cpd-22, 28 and 29 (each in an amount of $10^{-2}$ wt. % based on the amount of silver halide) were added to each of the light-sensitive layers. Alkanol XC (tradename of Du Pont) and sodium alkylbenzenesulfonate were added to each of the layers as dispersing assisting agent. A succinic acid ester and Magefac F120 (trade name of Dainippon Ink & Chemicals Inc.) were also added to each of the layers as coating assisting agent. Stabilizers of Cpd-23, Cpd-24 and Cpd-25 (in the ratio of 1:1:1) were added to each of the layers containing silver halide of colloidal silver.

The following compounds were employed for the preparation of the above sample.

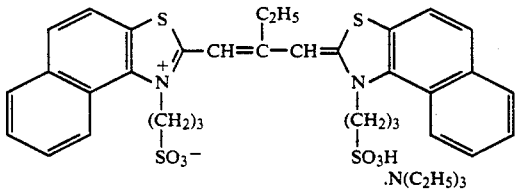

(ExS-1)

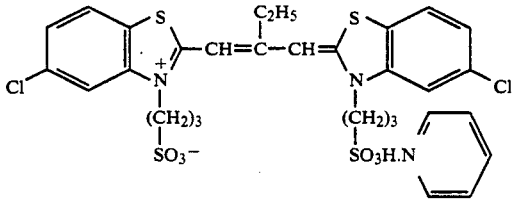

(ExS-2)

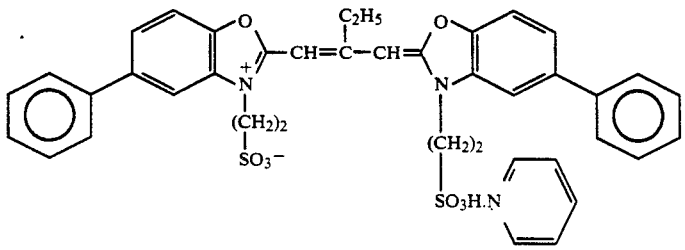

(ExS-3)

-continued
(ExS-4)
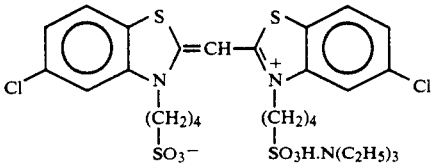
(ExS-5)
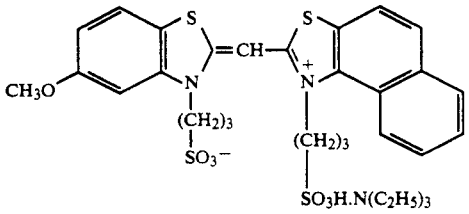
(Cpd-1)
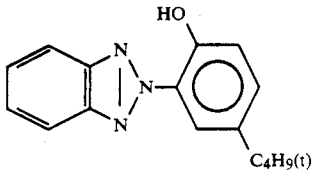
(Cpd-2)
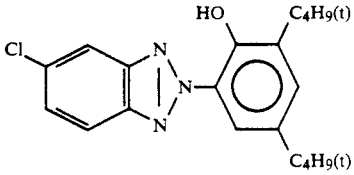
(Cpd-3)
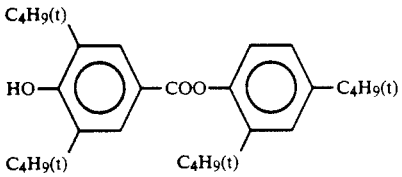
(Cpd-4)
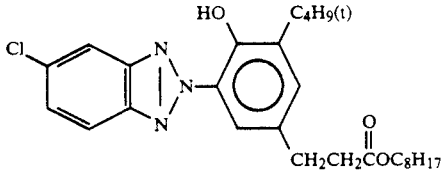
(Cpd-5)
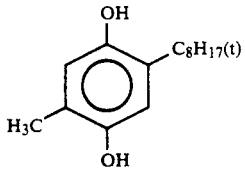
(Cpd-6)
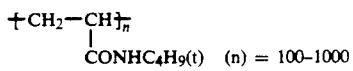
(Cpd-7)
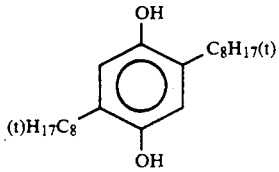
(Cpd-8)
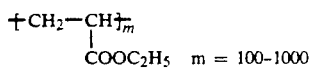

-continued
(Cpd-9)
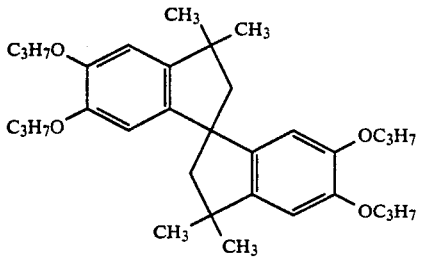
(Cpd-10)
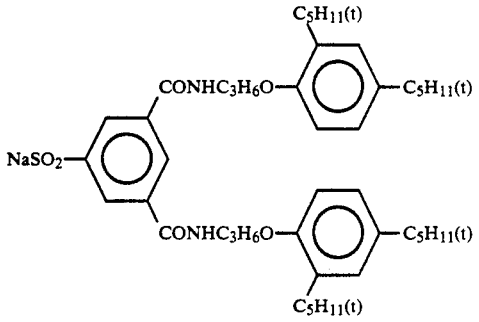
(Cpd-11)
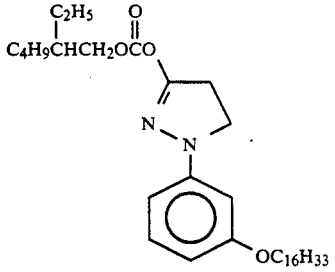
(Cpd-12)
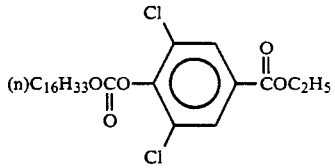
(Cpd-13)
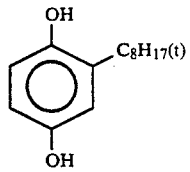
(Cpd-14)
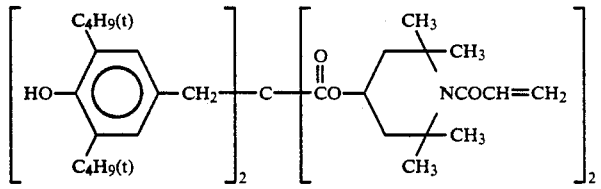
(Cpd-15)
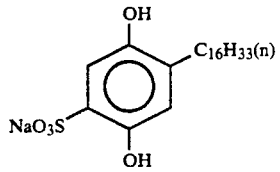

-continued
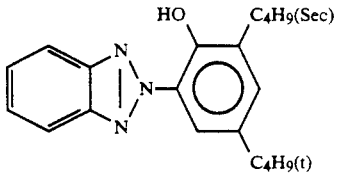
(Cpd-16)
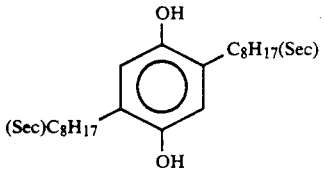
(Cpd-17)
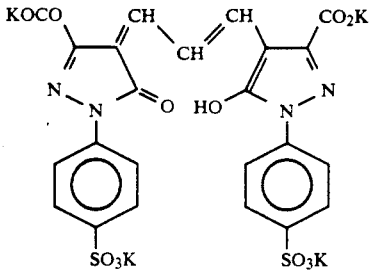
(Cpd-18)
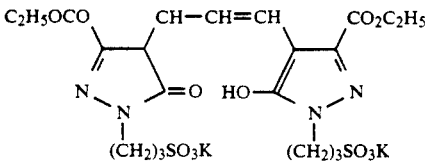
(Cpd-19)
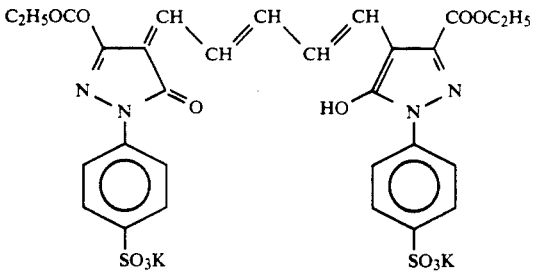
(Cpd-20)
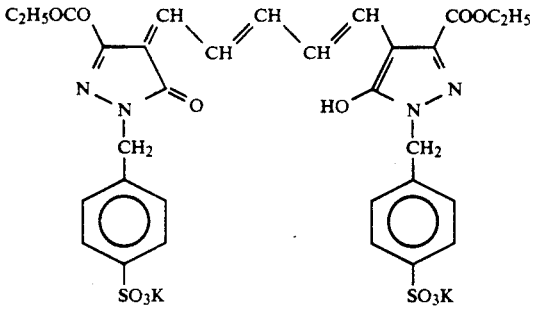
(Cpd-21)
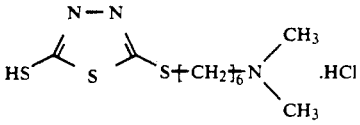
(Cpd-22)

-continued
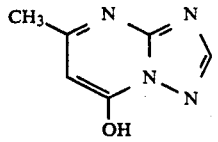
(Cpd-23)
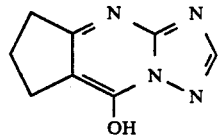
(Cpd-24)
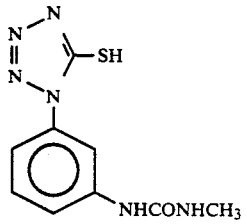
(Cpd-25)
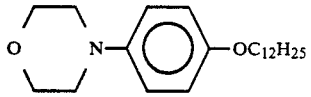
(Cpd-26)
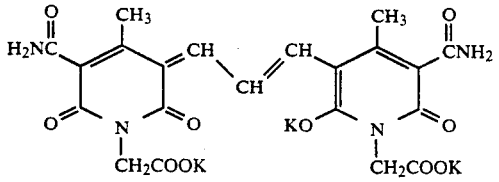
(Cpd-27)
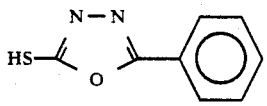
(Cpd-28)
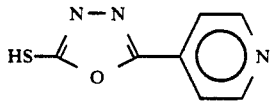
(Cpd-29)
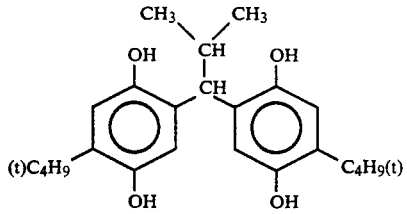
(Cpd-30)
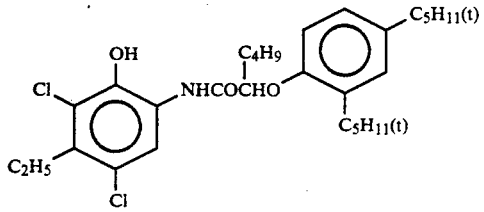
(EXC-1)

-continued
(EXC-2)
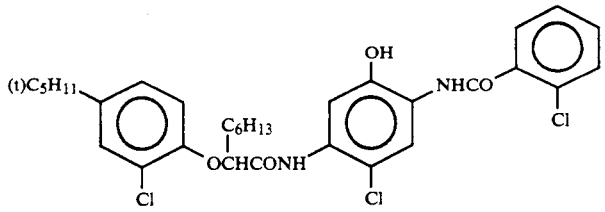
(EXC-3)
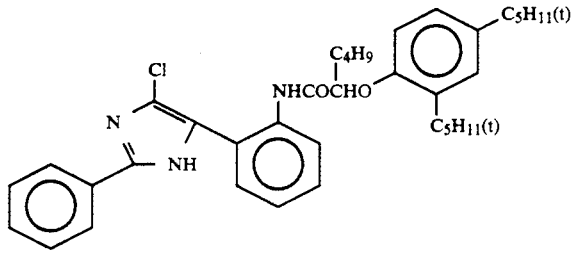
(EXM-1)
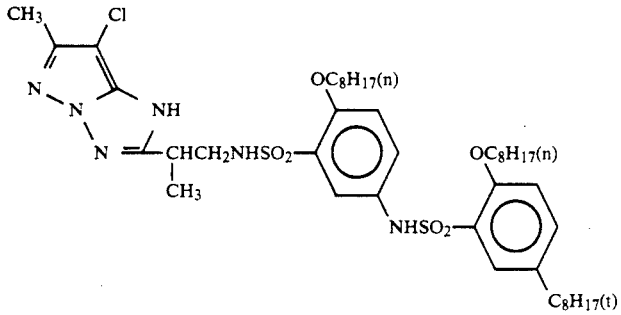
(EXM-2)
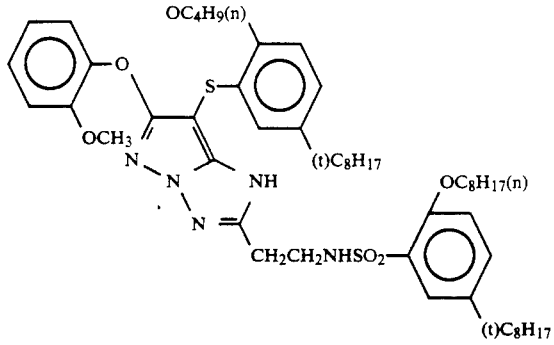
(EXY-1)
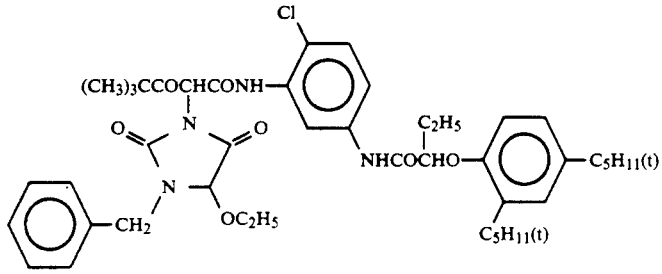

-continued (EXY-2)

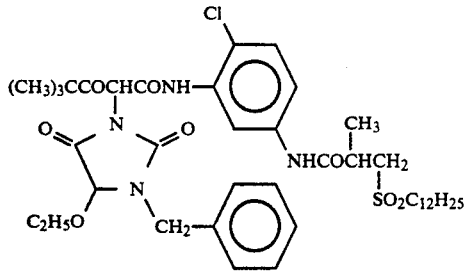

(EXY-3)

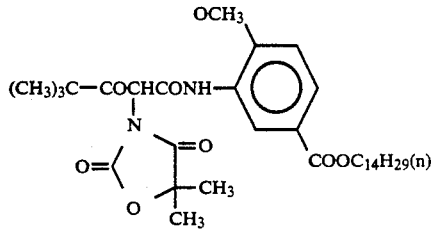

(Solv-1)

Di(2-ethylhexyl)sebacate (Solv-2)

Trinonyl phosphate (Solv-3)

Di(3-methylhexyl)phthalate (Solv-4)

Tricresyl phosphate (Solv-5)

Dibutyl phthalate (Solv-6)

Trioctyl phosphate (Solv-7)

Di(2-ethylhexyl)phthalate (H-1)

1,2-Bis(vinylsulfonylacetamide)ethane (H-2)

4,6-Dichloro-2-hydroxy-1,3,5-triazine sodium salt (ExZK-1)

7-(3-ethoxythiocarbonylaminobenzamido)-9-methyl-10-propargyl-1,2,3,4-tetrahydroacridinium trifluoromethanesulfonate (ExZK-2)

2-[4-{3-[3-{3-[5-{3-[2-chloro-5-(1-dodecyloxy--carbonylethoxycarbonyl)phenylcarbamoyl]-4-hydroxy-1-naphthylthio}tetrazole-1-yl]phenyl-}ureido]benzenesulfonamido}phenyl]-1-formylhydrazine Preparation of sample 202

The procedure for preparing the above sample 201 was repeated except for replacing the emulsion (EM-1) contained in the third layer (red sensitive layer), the emulsion (EM-1) contained in the fifth layer (green sensitive layer) and the emulsion (EM-1) contained in the ninth layer (blue sensitive layer) with the emulsion (EM-4), the emulsion (EM-3) and the emulsion (EM-2), respectively, to prepare a sample 202.

Evaluation of direct positive photographic light-sensitive material

The samples obtained as above were stored (incubated) for 10 days at a temperature of 50° C. and a relative humidity of 55%. Each of the samples having been not stored (i.e., samples before storage) and the samples having been stored as above (i.e., samples after storage) was subjected to wedge exposure (1/10 sec, 300 cms, color temperature: 4,800° K) and then processed in the same manner as described in Example 1 to obtain a characteristic curve.

Utilizing the characteristic curve, variations of cyan (R), magenta (G) and yellow (B) sensitivities of each sample between before and after the storage (incubation) were determined in the same manner as described in Example 1. Further, the gradation of the toe part and the minimum density of the image provided by each sample before and after the storage of the sample were also determined in the same manner as described in Example 1. The samples and the images provided by the samples were evaluated in the same manner as described in Example 1.

The results obtained by the above test are set forth in Table 1.

TABLE 2

| Sample No. | Addition of Sensitizing dye | Variation of Sensitivity (ΔlogE) | Gradation of Toe part | | Minimum Density | | Remark |
|---|---|---|---|---|---|---|---|
| | | | Before storage | After storage | Before storage | After storage | |
| 201 | (*1) | B: 0.10 | B: 0.20 | B: 0.23 | B: 0.110 | B: 0.124 | Comp. |
| | | G: 0.08 | G: 0.20 | G: 0.25 | G: 0.131 | G: 0.145 | |
| | | R: 0.07 | R: 0.19 | R: 0.22 | R: 0.094 | R: 0.110 | |
| 202 | (*2) | B: 0.03 | B: 0.19 | B: 0.20 | B: 0.110 | B: 0.116 | Example |

TABLE 2-continued

| Sample No. | Addition of Sensitizing dye | Variation of Sensitivity (ΔlogE) | Gradation of Toe part | | Minimum Density | | Remark |
|---|---|---|---|---|---|---|---|
| | | | Before storage | After storage | Before storage | After storage | |
| | | G: 0.02<br>R: 0.01 | G: 0.20<br>R: 0.19 | G: 0.20<br>R: 0.20 | G: 0.130<br>R: 0.095 | G: 0.135<br>R: 0.100 | |

(*1): The sensitizing dye was added to the coating solution for forming an emulsion layer.
(*2): The sensitizing dye was added after the formation of core grains of Step 1.

As is evident from the results set forth in Table 2, the light-sensitive material of the invention (sample 202) had small difference in the sensitivity between before and after the storage. Further, the image provided by the material hardly varied in the gradation of the toe part and in the minimum density even after the material was stored, resulting in high whiteness. In contrast thereto, the light-sensitive material for comparison (sample 201) had a large difference in the sensitivity between before and after the storage, and the image provided by the material was largely changed both in the gradation of the toe part and the minimum density after the material was stored, resulting in inferior whiteness.

I claim:

1. A direct positive photographic light-sensitive material comprising a support and a single light-sensitive emulsion layer provided thereon, said light-sensitive emulsion layer containing non-pre-fogged internal latent image type silver halide grains of a core/shell structure, the silver halide grains containing no silver iodide or containing silver iodide in an amount of not more than 3 mol % and having a mean grain size of 0.1 to 1.5 μm, and a molar ratio between silver halide in the cores of the silver halide grains and that in the shells of the silver halide grains is from 20:1 to 1:100, wherein the cores of the silver halide grains are sensitized with a spectral sensitizing dye and subsequently sensitized with a chemical sensitizer.

2. The direct positive photographic light-sensitive material as claimed in claim 1, wherein the spectral sensitizing dye is a cyanine dye, a merocyanine dye or a composite merocyanine dye.

3. The direct positive photographic light-sensitive material as claimed in claim 1, wherein said chemical sensitizer consists essentially of a sulfur sensitizer and a gold sensitizer.

4. The direct positive photographic light-sensitive material as claimed in claim 1, wherein said chemical sensitizer consists essentially of a sulfur sensitizer, a gold sensitizer and a selenium sensitizer.

5. A direct positive photographic light-sensitive material comprising a support and light-sensitive emulsion layers provided on said support, wherein said light-sensitive emulsion layers comprise:

a red-sensitive layer containing a non-pre-fogged internal latent image type silver halide emulsion and a cyan coupler, a green-sensitive layer containing a non-pre-fogged internal latent image type silver halide emulsion and a magenta coupler, and a blue-sensitive layer containing a non-pre-fogged internal latent image type silver halide emulsion and a yellow coupler; and, wherein said non-pre-fogged internal latent image type silver halide emulsion present in said light-sensitive emulsion layers contains silver halide grains having a core/shell structure, wherein said silver halide grains contain no silver iodide or contain silver iodide in an amount of not more than 3 mol % and have a mean grain size of 0.1 to 1.5 μm, and a molar ratio between silver halide in the cores of the silver halide grains and that in the shells of the silver halide grains is from 20:1 to 1:100, wherein the cores of the silver halide grains are sensitized with a spectral sensitizing dye and subsequently sensitized with a chemical sensitizer.

* * * * *